US009033746B1

(12) United States Patent
Wu

(10) Patent No.: US 9,033,746 B1
(45) Date of Patent: May 19, 2015

(54) RAIL-BASED FASTENING STRUCTURE FOR TERMINAL BLOCK

(71) Applicant: Dinkle Enterprise Co., Ltd., New Taipei (TW)

(72) Inventor: Shang Tsai Wu, New Taipei (TW)

(73) Assignee: DINKLE ENTERPRISE CO., LTD., New Taipei (TW)

( * ) Notice: Subject to any disclaimer, the term of this patent is extended or adjusted under 35 U.S.C. 154(b) by 17 days.

(21) Appl. No.: 14/071,840

(22) Filed: Nov. 5, 2013

(51) Int. Cl.
*H01R 9/26* (2006.01)
*H01R 25/14* (2006.01)
*H01R 9/24* (2006.01)

(52) U.S. Cl.
CPC ..... *H01R 25/145* (2013.01); *H01R 9/24* (2013.01)

(58) Field of Classification Search
CPC ..... H01R 25/145; H01R 9/24
USPC ..... 439/212–214, 532, 709, 715, 716
See application file for complete search history.

(56) References Cited

U.S. PATENT DOCUMENTS

| | | | | |
|---|---|---|---|---|
| 7,806,719 | B2 * | 10/2010 | Beier et al. | 439/410 |
| 7,980,902 | B2 * | 7/2011 | Capaldi-Tallon | 439/716 |
| 8,011,951 | B2 * | 9/2011 | Moore et al. | 439/532 |
| 8,668,518 | B2 * | 3/2014 | Wu | 439/532 |
| 8,678,855 | B2 * | 3/2014 | Fasce et al. | 439/532 |

* cited by examiner

*Primary Examiner* — Khiem Nguyen
(74) *Attorney, Agent, or Firm* — Birch, Stewart, Kolasch & Birch, LLP

(57) ABSTRACT

A rail-based fastening structure for terminal blocks includes a fastening clip, a positioning rail and a bus body. The fastening clip has a base plate and two side plates each extending upward from the base plate and having an engaging hook. The positioning rail includes a bottom plate and two tracks extending upward and then outward from two opposite sides of the bottom plate, so that the bottom plate and the tracks define a valley. The bottom plate has an opening. The bus body deposited in the valley has a slot and two shoulder portions. The shoulder portions are positioned at two sides of the slot and extend toward the slot. The fastening clip is inserted into the opening through the slot so that the engaging hooks engage with the shoulder portions, respectively. Thereby, the rail-based fastening structure allows quick and convenient mounting/dismounting operation, low manufacturing costs and firm installation.

4 Claims, 13 Drawing Sheets

RAIL-BASED FASTENING STRUCTURE FOR TERMINAL BLOCK

BACKGROUND OF THE INVENTION

1. Technical Field

The present invention relates to rail-based fastening structures for terminal blocks, and more particularly to a rail-based fastening structure for terminal blocks that allows quick and convenient mounting/dismounting operation, low manufacturing costs and firm installation.

2. Description of Related Art

A rail-based fastening structure is an electronic component that extensively used in various devices and serves to connect two or more terminal blocks. Such a rail-based fastening structure primarily comprises a positioning rail and a bus body that has a plurality of conductive bars and is settled in the positioning rail's valley.

Please refer to FIG. 1 for a perspective view of a conventional rail-based fastening structure for terminal blocks. As shown in FIG. 1, traditionally, the rail-based fastening structure 91 comprises a positioning rail 911 and a bus body 912 that is received in a valley 913 of the positioning rail 911.

Furthermore, the positioning rail 911 shown in FIG. 1 has two tracks 914 extending upward from its two lengthwise sides, and at each of the two lengthwise sides of the bus body 912 there is one or a plurality of engaging hooks 915 provided, such that when the bus body 912 is received in the valley 913 of the positioning rail 911, the engaging hooks 915 can engage with the tracks 914 to hold the bus body 912 and the positioning rail 911 together.

SUMMARY OF THE INVENTION

According to the present invention, a rail-based fastening structure for terminal blocks comprises a fastening clip, a positioning rail and a bus body. The fastening clip has a base plate and two side plates, wherein each of the two side plates extends upward from the base plate and has at least one engaging hook projecting outward. The positioning rail includes a bottom plate and two tracks, wherein the two tracks extend upward and then outward from two opposite sides of the bottom plate so that bottom plate and the two tracks jointly define a valley and the bottom plate has at least one opening. The bus body is deposited in the valley and comprises a slot and two shoulder portions, wherein the two shoulder portions are positioned at two opposite sides of the slot and extend toward the slot. Therein, the fastening clip is inserted into the slot through the at least one opening from below so that the engaging hooks of the two side plates engage with the two shoulder portions, respectively.

The aforementioned rail-based fastening structure further comprises two shoulder plates extend upward from the base plate and are positioned outside the two side plates, respectively, so as to be aligned with the engaging hooks of the two side plate, and the two shoulder plates are lower than the two side plates.

In the aforementioned rail-based fastening structure, each of the two shoulder plates has at least one retaining hook projecting outward.

In the aforementioned rail-based fastening structure, the bottom plate further comprises two raised shoulder portions that are positioned at two sides of the at least one opening and extend toward the at least one opening, so that the retaining hooks of the two shoulder plates engage the two raised shoulder portions, respectively.

As described above, the disclosed configuration is designed to allow quick and convenient mounting/dismounting operation, low manufacturing costs and firm installation.

DETAILED DESCRIPTION OF THE INVENTION

Figure 1:
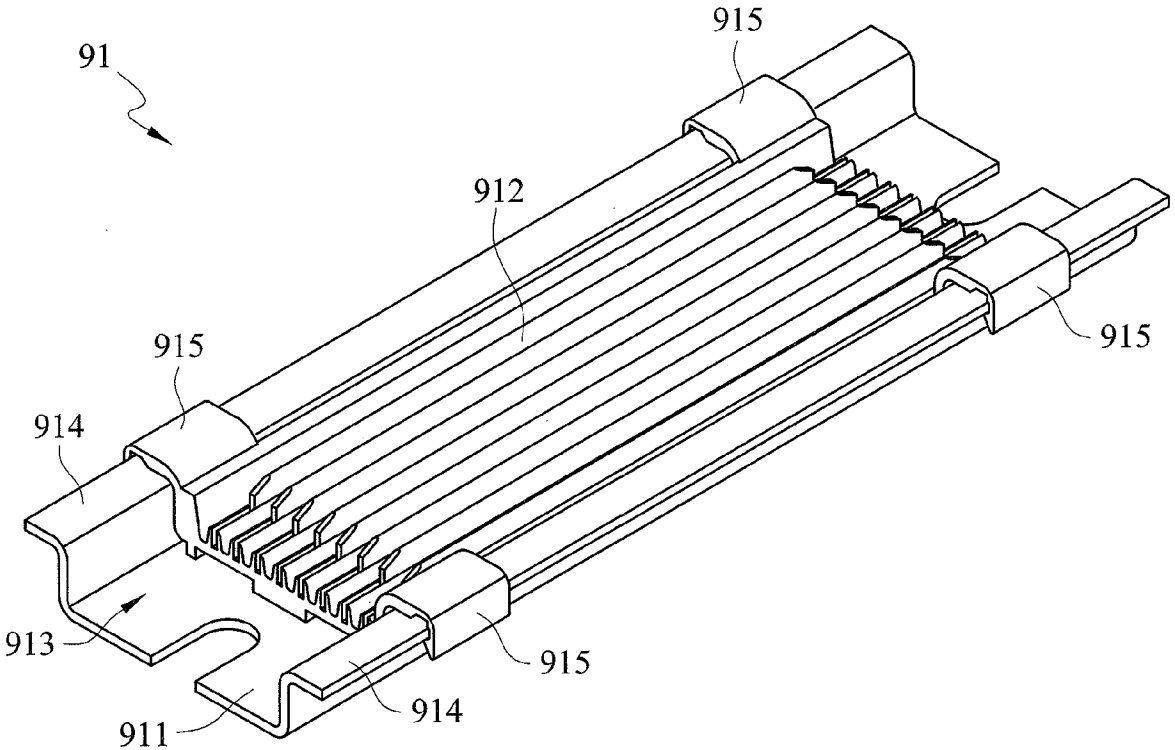
FIG. 1 is a perspective view of a conventional rail-based fastening structure for terminal blocks.
Figure 2:
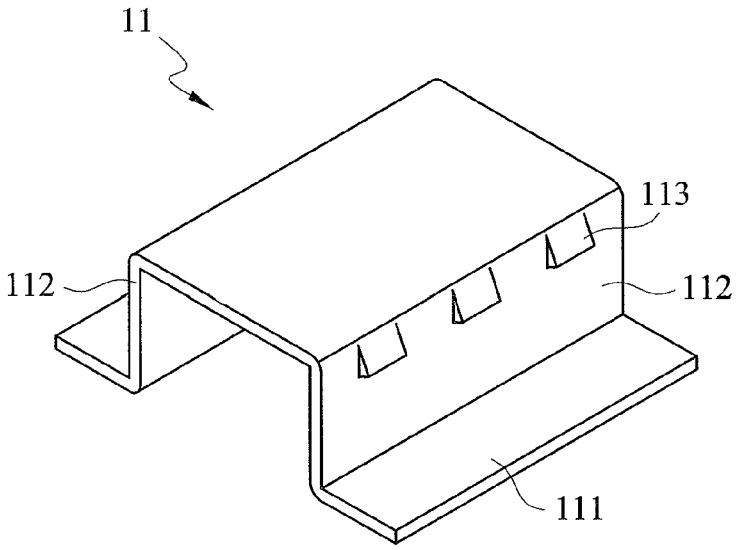
FIG. 2 is a perspective view of a fastening clip according to a first preferred embodiment of the present invention.

Please refer to FIG. 2 for a perspective view of a fastening clip according to a first preferred embodiment of the present invention.

As shown in FIG. 2, the fastening clip 11 comprises a base plate 111 and two side plates 112 extending upward from the base plate 111. Each of the two side plates 112 has at least one engaging hook 113 projecting outward. As depicted, in the present embodiment, the two side plates 112 each have three separated engaging hooks 113 projecting outward and the two side plates 112 are connected with each other. While FIG. 2 only displays the engaging hooks 113 of one said side plate 112 due to perspective limitation, the side plate 112 at the other side also has the engaging hooks 113.

Figure 3:
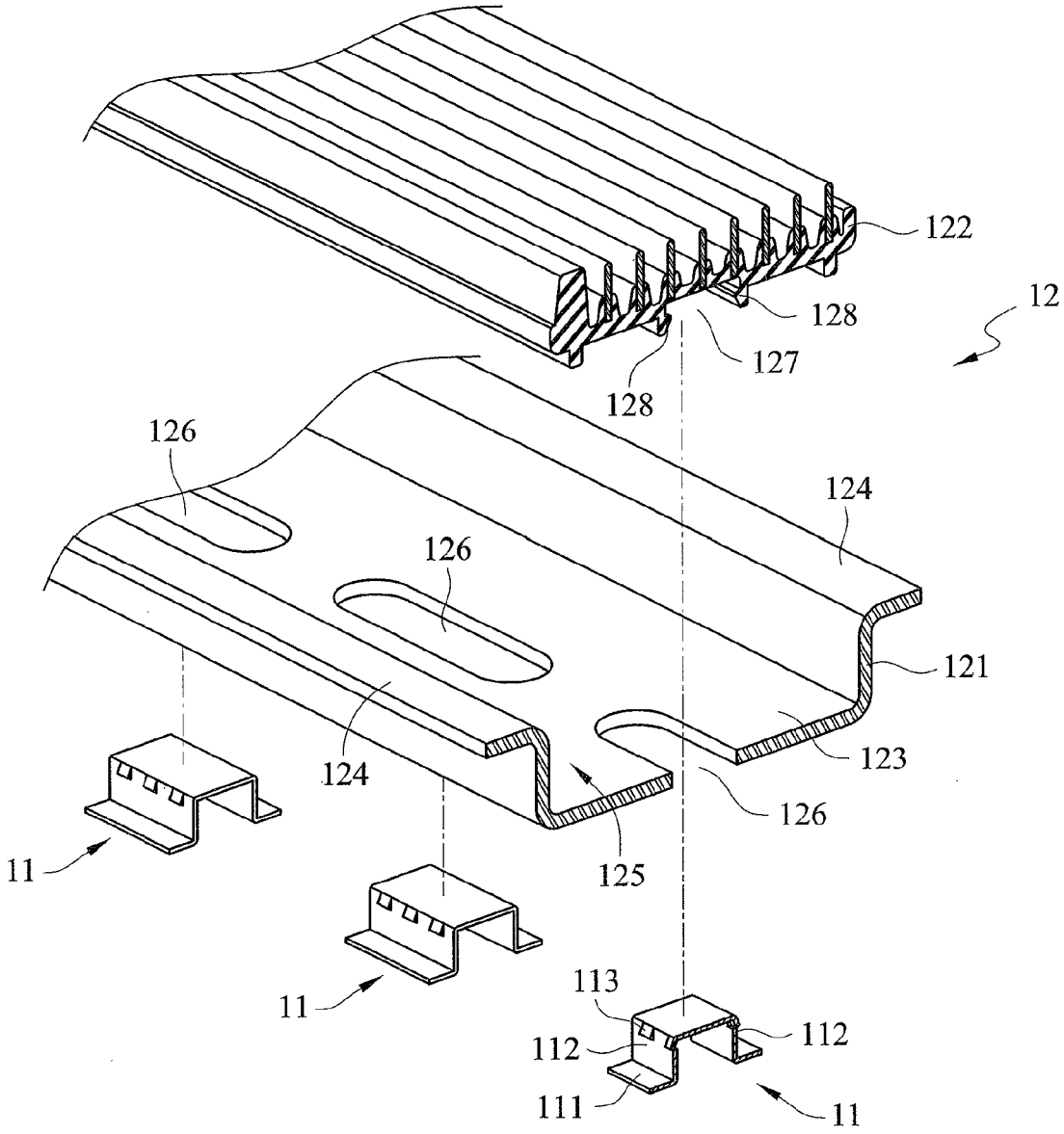
FIG. 3 is an exploded view of a rail-based fastening structure for terminal blocks and the fastening clips according to the first preferred embodiment of the present invention.
Figure 4:
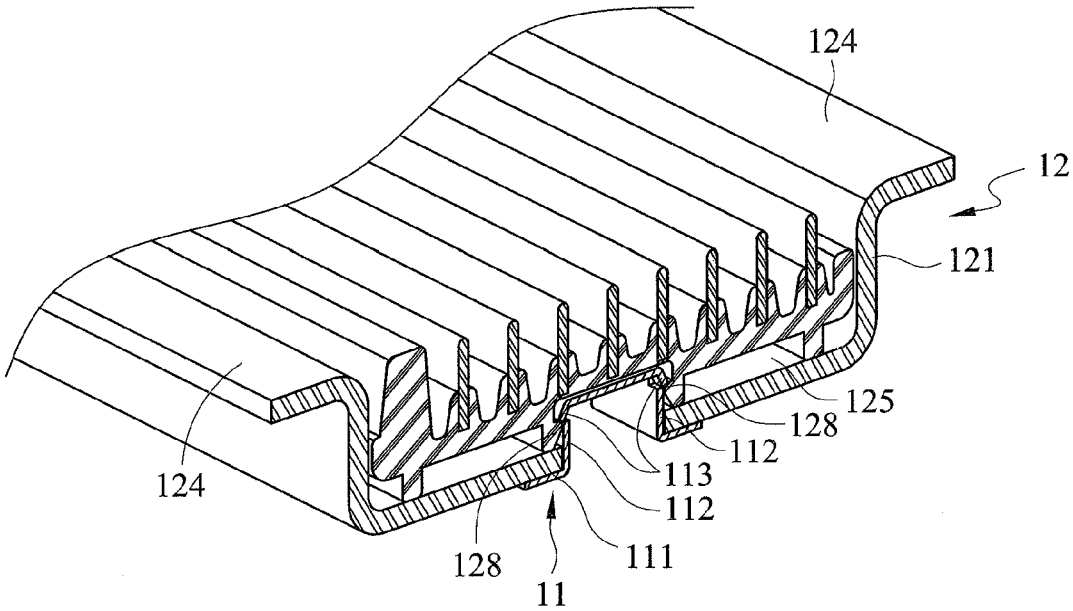
FIG. 4 is a perspective view of the rail-based fastening structure and the fastening clips assembled according to the first preferred embodiment of the present invention.

Please refer to FIG. 3 and FIG. 4 together. FIG. 3 is an exploded view of a rail-based fastening structure for terminal blocks and the fastening clips according to the first preferred embodiment of the present invention. FIG. 4 is a perspective view of the rail-based fastening structure and the fastening clips assembled according to the first preferred embodiment of the present invention. FIG. 2 is also to be referred to herein.

As shown in FIG. 3 and FIG. 4, a rail-based fastening structure 12 is configured to work with the foregoing fastening clip 11. In the present embodiment, plural said fastening clips 11 are implemented and there may be two, three or more said engaging hooks 113 provided on the side plate 112 of the fastening clip 11.

In addition, the rail-based fastening structure 12 as shown comprises a positioning rail 121 and a bus body 122. Therein, the positioning rail 121 includes a bottom plate 123 and two tracks 124. The two tracks 124 extend upward and then outward from two opposite sides of the bottom plate 123, respectively. The bottom plate 123 and the two tracks 124 jointly define a valley 125. The bottom plate 123 comprises at least one opening 126. In the present embodiment, the bottom plate 123 is formed with a plurality of openings 126. The bus body 122 is received in the valley 125 of the positioning rail 121. The bus body 122 comprises a slot 127 and two shoulder portions 128. The two shoulder portions 128 are positioned at two opposite sides of the slot 127 and extend toward the slot 127.

During the assembling operation, as shown in FIG. 3 and FIG. 4, the fastening clips 11 are inserted into the slot 127 of the bus body 122 through the opening 126 of the bottom plate 123 of the positioning rail 121 from below, so that the engaging hooks 113 at the side plates 112 of the fastening clips 11 engage with the two shoulder portions 128 of the bus body 122.

With the configuration of the fastening clip 11 as described above, the bus body 122 can be firmly held in the valley 125 of the positioning rail 121. Dismounting the bus body 122 from the positioning rail 121 can be easily performed by removing the fastening clips 11.

With the fastening clip 11 such configured, quick and convenient mounting/dismounting operation, low manufacturing costs and firm installation are achievable. Moreover, the fastening clip 11 as described above is compatible to bus bodies with and without engaging hooks.

Figure 5:
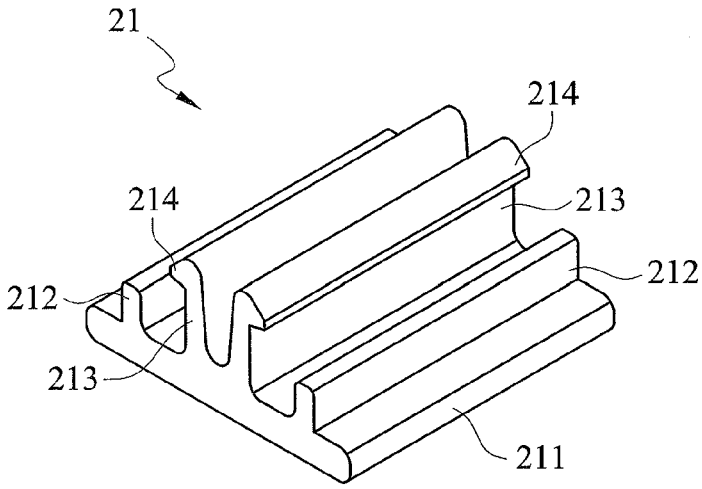
FIG. 5 is a perspective view of a fastening clip according to a second preferred embodiment of the present invention.

Please refer to FIG. 5 for a perspective view of a fastening clip according to a second preferred embodiment of the present invention.

The fastening clip 21 shown in FIG. 5 is substantially similar to that of the first preferred embodiment. However, the fastening clip 21 of FIG. 5 has two shoulder plates 212 extending upward from the base plate 211. The two shoulder plates 212 are positioned outside the two side plates 213 and aligned with the engaging hooks 214 of the two side plates 213. The two shoulder plates 212 are lower than the two side plates 213. In other words, the height of each of the two shoulder plates 212 is smaller than that of the side plate 213. As shown, in the present embodiment, the two side plates 213 of the fastening clip 21 are not connected with each other and the engaging hooks 214 are integratedly formed with the two side plates 213.

Figure 6:
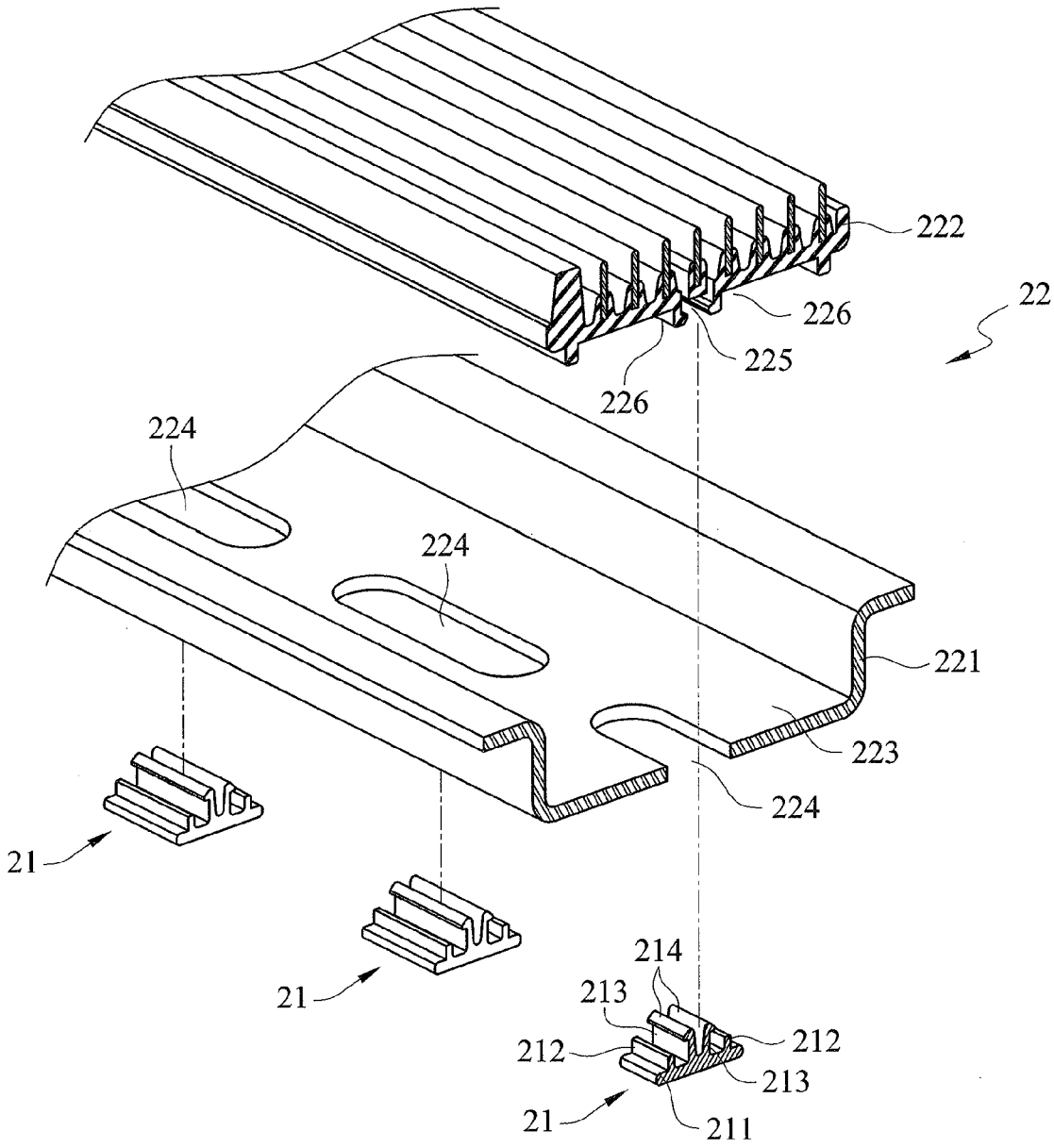
FIG. 6 is an exploded view of a rail-based fastening structure for terminal blocks and the fastening clips according to the second preferred embodiment of the present invention.
Figure 7:
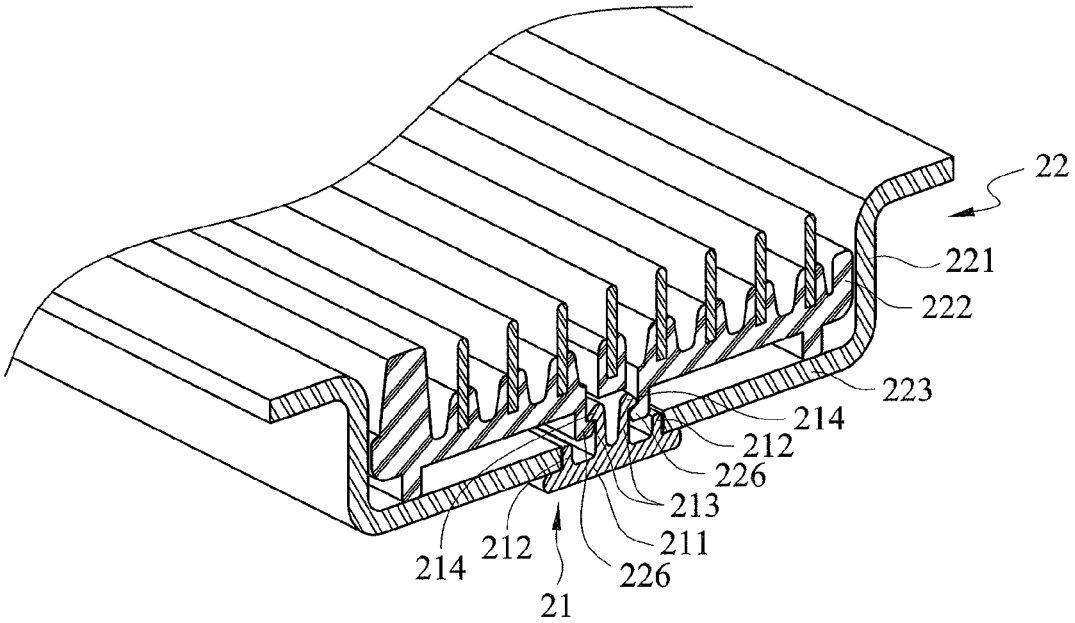
FIG. 7 is a perspective view of the rail-based fastening structure and the fastening clips assembled according to the second preferred embodiment of the present invention.

Please refer to FIG. 6 and FIG. 7 together. FIG. 6 is an exploded view of a rail-based fastening structure for terminal blocks and the fastening clips according to the second preferred embodiment of the present invention. FIG. 7 is a perspective view of the rail-based fastening structure and the fastening clips assembled according to the second preferred embodiment of the present invention. FIG. 5 is also to be referred to herein.

Similarly, during the assembling operation, as shown in FIG. 6 and FIG. 7, the fastening clip 21 is inserted into the slot 225 of the bus body 222 through the opening 224 of the bottom plate 223 of the positioning rail 221 of the rail-based fastening structure 22 from below, so that the engaging hooks 214 of the two side plates 213 of the fastening clip 21 engage with the two shoulder portions 226, respectively.

Thus, the second preferred embodiment such configured is also able to function as the previous preferred embodiment.

Figure 8:
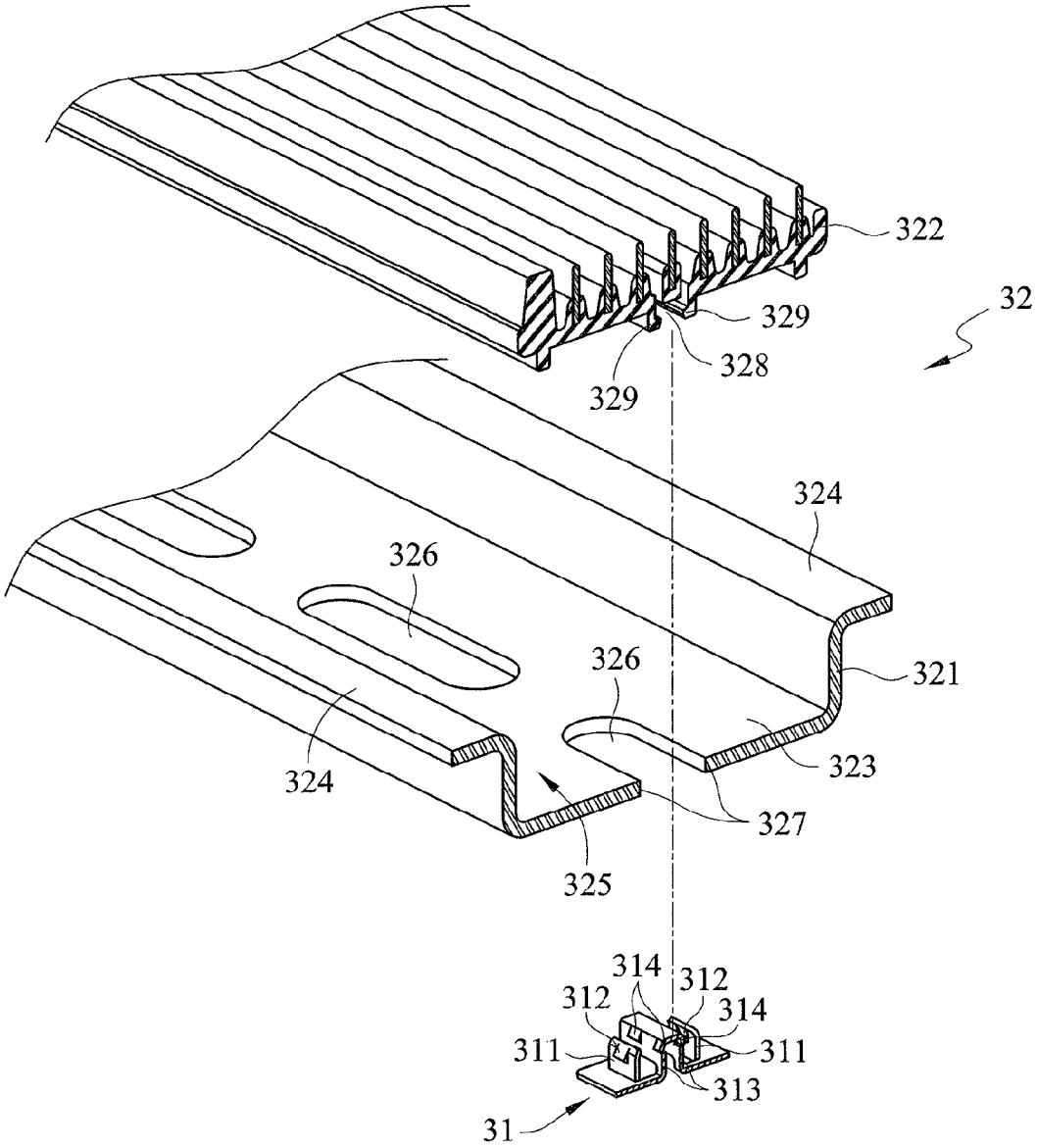
FIG. 8 is an exploded view of a rail-based fastening structure for terminal blocks and a fastening clip according to a third preferred embodiment of the present invention.
Figure 9:
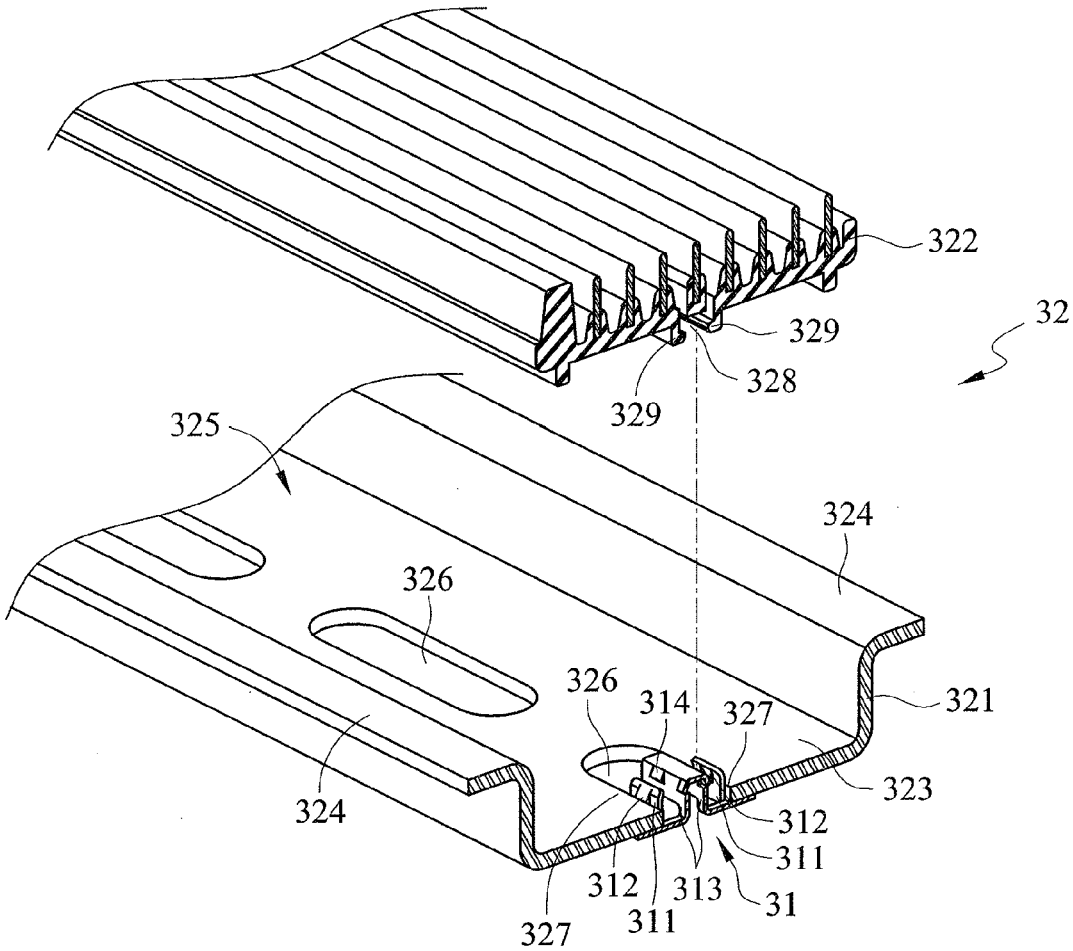
FIG. 9 illustrates the assembling operation of the rail-based fastening structure and the fastening clip according to the third preferred embodiment of the present invention.
Figure 10:
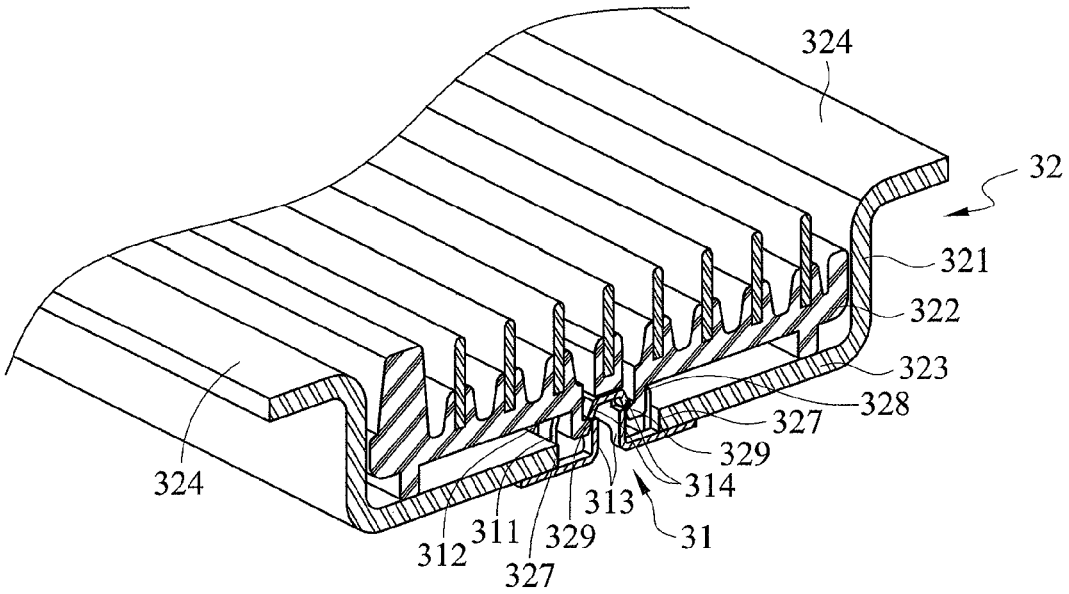
FIG. 10 is a perspective view of the rail-based fastening structure and the fastening clip assembled according to the third preferred embodiment of the present invention.

Please refer to FIG. 8 through FIG. 10. FIG. 8 is an exploded view of a rail-based fastening structure for terminal blocks and a fastening clip according to a third preferred embodiment of the present invention. FIG. 9 illustrates the assembling operation of the rail-based fastening structure and the fastening clip according to the third preferred embodiment of the present invention. FIG. 10 is a perspective view of the rail-based fastening structure and the fastening clip assembled according to the third preferred embodiment of the present invention.

The fastening clip 31 shown in FIG. 8 through FIG. 10 is structurally similar to the fastening clip 11 of the first preferred embodiment (referring to FIG. 2), and the difference there between relies on that fact that the each of the two shoulder plates 311 of the fastening clip 31 further has at least one retaining hook 312 projecting outward. In the present embodiment, the two shoulder plates 311 each have two separated retaining hooks 312 projecting outward. Of course, the number of the retaining hooks 312 is not to be limited.

Also shown in the figures is a rail-based fastening structure 32 for working with the above-mentioned fastening clip 31. The rail-based fastening structure 32 comprises a positioning rail 321 and a bus body 322. Therein, the positioning rail 321 includes a bottom plate 323 and two tracks 324. The two track 324 each extend upward and then outward from two opposite sides of the bottom plate 323 so that the bottom plate 323 and the two tracks 324 jointly define a valley 325. The bottom plate 323 has at least one opening 326 and two raised shoulder portions 327. The two raised shoulder portions 327 are positioned at two opposite sides of the at least one opening 326 and extend toward the at least one opening 326. In the present embodiment, the bottom plate 323 is formed with a plurality of openings 326. The two raised shoulder portions 327 are formed at two sides of each said opening 326. The bus body 322 is received in the valley 325 of the positioning rail 321. The bus body 322 comprises a slot 328 and two shoulder portions 329. The two shoulder portions 329 are positioned at two sides of the slot 328 and extend toward the slot 328.

During the assembling operation, as shown in FIG. 9 and FIG. 10, the fastening clip 31 is inserted into the slot 328 of the bus body 322 through the opening 326 of the bottom plate 323 of the positioning rail 321 from below, so that the retaining hooks 312 on the two shoulder plates 311 of the fastening clip 31 engage with the raised shoulder portions 327 of the bottom plate 323 of the positioning rail 321, respectively, and the engaging hooks 314 of the two side plates 313 of the fastening clip 31 engage with the two shoulder portions 329 of the bus body 322, respectively.

Particularly, when the fastening clip 31 is inserted from below, the retaining hooks 312 of the two shoulder plates 311 of the fastening clip 31 first engage with the raised shoulder portions 327 of the bottom plate 323 of the positioning rail 321, causing the fastening clip 31 to firmly combine with the positioning rail 321 (as shown in FIG. 9), so as to facilitate the assembling operation as the fastening clip 31 is positioned on the positioning rail 321 and prevented from falling off. Afterward, the engaging hooks 314 of the two side plates 313 of the fastening clip 31 engage with the two shoulder portions 329 of the bus body 322, causing the fastening clip 31, the positioning rail 321 and the bus body 322 to be assembled together firmly.

Consequently, the third preferred embodiment such configured is also able to function as the previous preferred embodiments.

Figure 11:
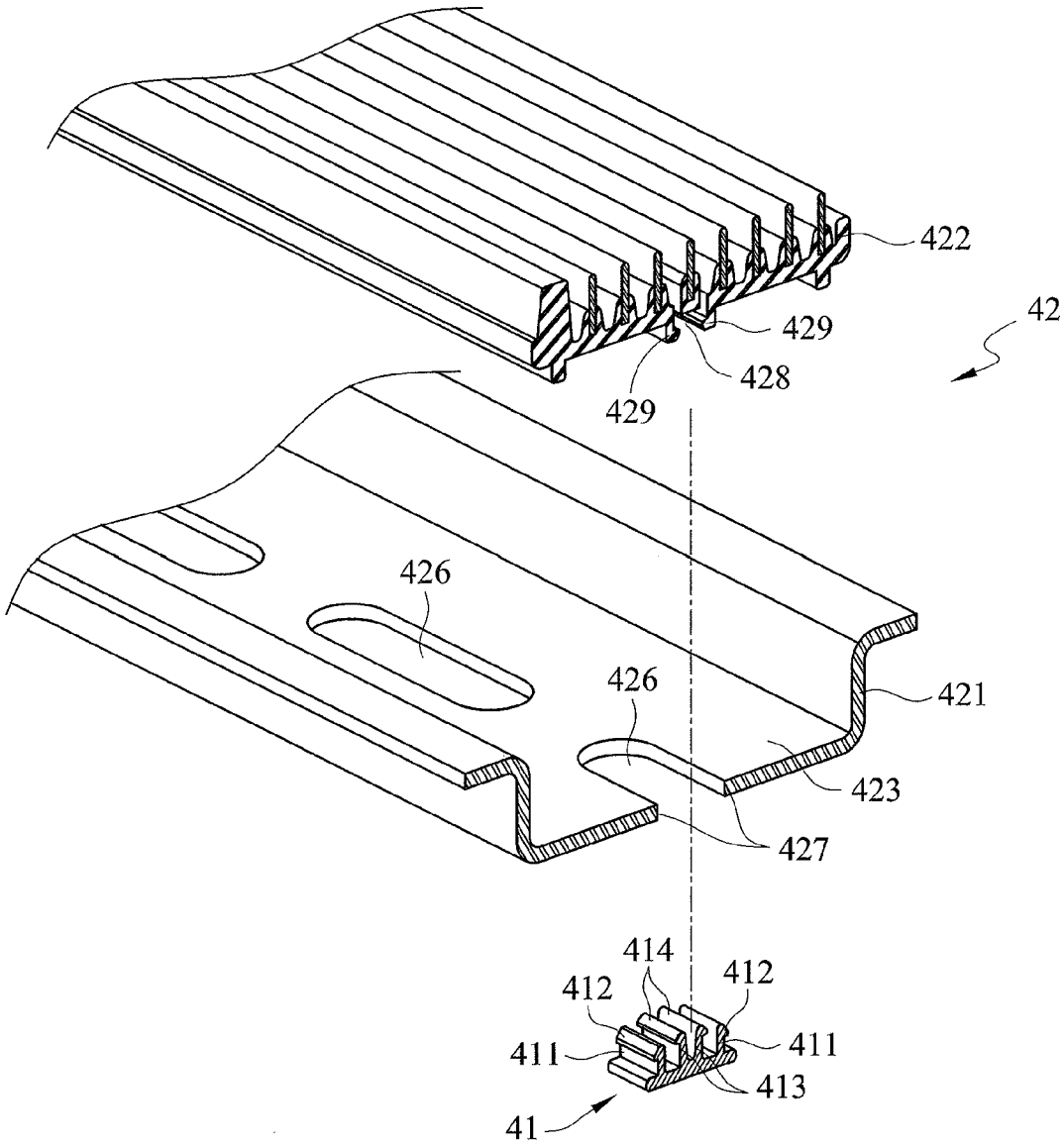
FIG. 11 is an exploded view of a rail-based fastening structure for terminal blocks and a fastening clip according to a fourth preferred embodiment of the present invention.
Figure 12:
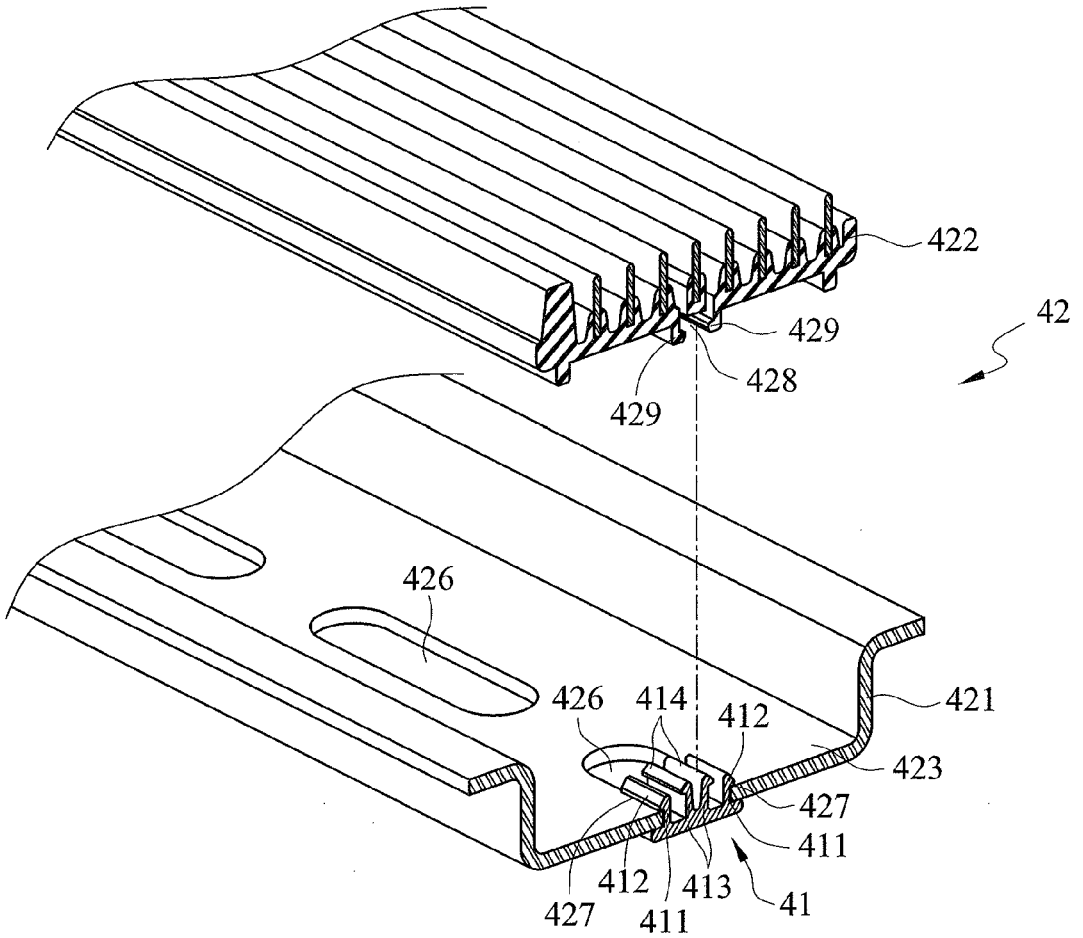
FIG. 12 illustrates the assembling operation of the rail-based fastening structure and the fastening clip according to the fourth preferred embodiment of the present invention.
Figure 13:
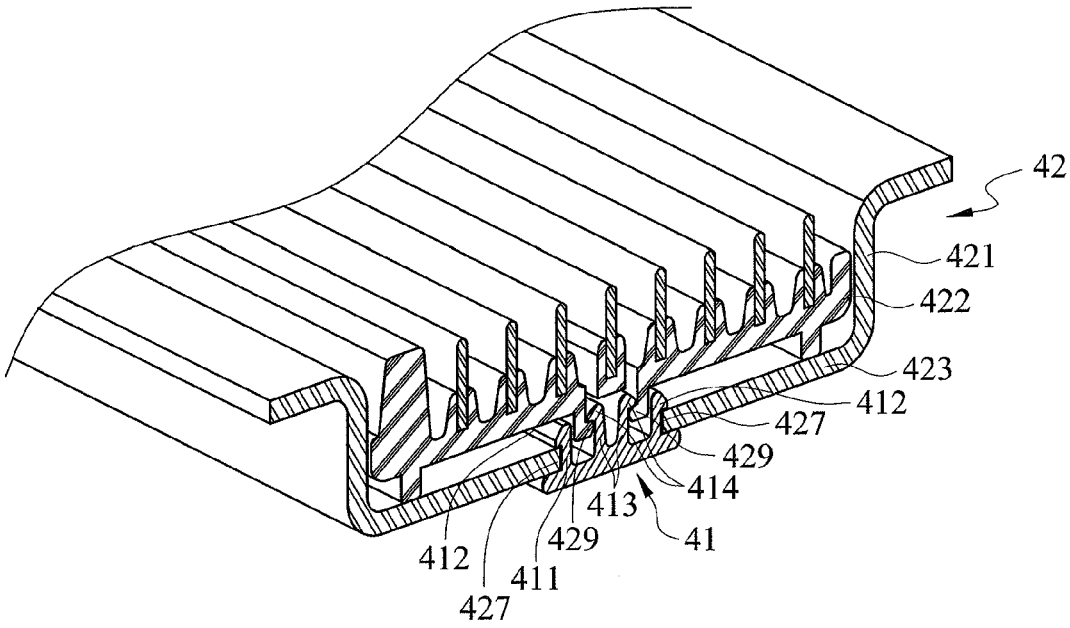
FIG. 13 is a perspective view of the rail-based fastening structure and the fastening clip assembled according to the fourth preferred embodiment of the present invention.

Please refer to FIG. 11 through FIG. 13. FIG. 11 is an exploded view of a rail-based fastening structure for terminal blocks and a fastening clip according to a fourth preferred embodiment of the present invention. FIG. 12 illustrates the assembling operation of the rail-based fastening structure and the fastening clip according to the fourth preferred embodiment of the present invention. FIG. 13 is a perspective view of the rail-based fastening structure and the fastening clip assembled according to the fourth preferred embodiment of the present invention.

The fastening clip 41 shown in FIG. 11 through FIG. 13 is structurally similar to the fastening clip 21 of the second preferred embodiment (referring to FIG. 5), and the only difference is that the each of the two shoulder plates 411 projects outward and has at least one retaining hook 412. In the present embodiment, the retaining hook 412 is integratedly formed with and projecting outward from the shoulder plate 411.

During the assembling operation, similar to the third preferred embodiment, the fastening clip 41 is inserted into the slot 428 of the bus body 422 through the opening 426 of the bottom plate 423 of the positioning rail 421 from below. The retaining hooks 412 of the two shoulder plates 411 of the fastening clip 41 engage with the raised shoulder portions 427 of the bottom plate 423 of the positioning rail 421, respectively, and the engaging hooks 414 of the two side plates 413 of the fastening clip 41 engage with the two shoulder portions 429 of the bus body 422, respectively.

Particularly, when the fastening clip 41 is inserted from below, the retaining hooks 412 of the two shoulder plates 411 of the fastening clip 11 first engage with the raised shoulder portions 427 of the bottom plate 423 of the positioning rail 421, causing the fastening clip 41 to firmly combine with the positioning rail 421 (as shown in FIG. 12), so as to facilitate the assembling operation as the fastening clip 41 is positioned on the positioning rail 421 and prevented from falling off. Afterward, the engaging hooks 414 of the two side plates 413 of the fastening clip 41 engage with the two shoulder portions 429 of the bus body 422, causing the fastening clip 41, the positioning rail 421 and the bus body 422 to be assembled together firmly.

Hence, as described above, the fourth preferred embodiment such configured is also able to function as the previous preferred embodiments.

What is claimed is:

1. A rail-based fastening structure for terminal blocks, the rail-based fastening structure comprising:

a fastening clip, having a base plate and two side plates, wherein each of the two side plates extends upward from the base plate and has at least one engaging hook projecting outward;

a positioning rail, including a bottom plate and two tracks, wherein the two tracks extend upward and then outward from two opposite sides of the bottom plate so that bottom plate and the two tracks jointly define a valley, and the bottom plate has at least one opening; and a bus body, deposited in the valley and comprising a slot and two shoulder portions, wherein the two shoulder portions are positioned at two opposite sides of the slot and extend toward the slot, in which the fastening clip is inserted into the slot through the at least one opening from below so that the engaging hooks of the two side plates engage with the two shoulder portions, respectively.

2. The rail-based fastening structure of claim 1, further comprising two shoulder plates extend upward from the base plate and are positioned outside the two side plates, respectively, so as to be aligned with the engaging hooks of the two side plate, and the two shoulder plates are lower than the two side plates.

3. The rail-based fastening structure of claim 2, wherein each of the two shoulder plates has at least one retaining hook projecting outward.

4. The rail-based fastening structure of claim 3, wherein the bottom plate further comprises two raised shoulder portions that are positioned at two sides of the at least one opening and extend toward the at least one opening, so that the retaining hooks of the two shoulder plates engage the two raised shoulder portions, respectively.

* * * * *